United States Patent [19]

Lennon

[11] 4,405,111

[45] Sep. 20, 1983

[54] INTERJOIST SUPPORT

[76] Inventor: Thomas C. Lennon, 1473 Pecan Tree Dr., Germantown, Tenn. 38138

[21] Appl. No.: 256,545

[22] Filed: Apr. 22, 1981

[51] Int. Cl.[3] ..... F16M 13/00

[52] U.S. Cl. ..... 248/544; 211/105.4

[58] Field of Search ..... 248/544, 57, 217.2, 248/DIG. 6, 264, 201, 354 S, 405, 406; 211/105.5, 105.4, 123, 105.1, 105.2, 105.3, 105.6; 52/632; 403/19, 44, 105; 285/39; 81/121 R

[56] References Cited

U.S. PATENT DOCUMENTS

| | | | |
|---|---|---|---|
| 670,585 | 3/1901 | Fowler | 211/105.4 |
| 2,293,168 | 8/1942 | Pirone | 211/105.4 |
| 2,518,452 | 8/1950 | Davis, Jr. et al. | 248/354 S |
| 2,541,793 | 2/1951 | Thompson | 248/354 S |
| 2,544,780 | 3/1951 | Dean | 248/354 S |
| 2,964,276 | 12/1960 | Silverthorne | 248/264 X |
| 2,974,806 | 3/1961 | Seewack | 211/105.4 |
| 3,222,030 | 12/1965 | Thorpe | 248/354 S |
| 3,830,219 | 8/1974 | Gibbs | 248/354 S |
| 4,111,217 | 9/1978 | Victor | 248/354 S X |

FOREIGN PATENT DOCUMENTS

| | | | |
|---|---|---|---|
| 135064 | 11/1949 | Australia | 248/354 S |
| 2746562 | 4/1979 | Fed. Rep. of Germany | 248/544 |
| 192810 | 9/1937 | Switzerland | 211/105.4 |

*Primary Examiner*—William H. Schultz
*Assistant Examiner*—Ramon O. Ramirez
*Attorney, Agent, or Firm*—Littlepage & Webner

[57] ABSTRACT

An extensible rod-like support engages between opposing surfaces of wall studs or ceiling joists and is formed of telescoping rod members that threadedly engage, one within the other. A tubular nut-driving wrench engages over a nut surface on one telescoping member enabling the use of a wrench to turn the member while another wrench is used to turn the other telescoping member, which has a non-round external surface.

5 Claims, 4 Drawing Figures

INTERJOIST SUPPORT

FIELD OF INVENTION

Interjoist Supports

PRIOR ART

Steketee U.S. Pat. No. 2,140,861
Fowler et al. U.S. Pat. No. 2,661,850
Burkey U.S. Pat. No. 2,725,989
Silverthorne U.S. Pat. No. 2,964,276

OBJECTS

The object of the invention is to provide a support for spanning between ceiling joists or wall studs, or similar spaced elements having opposing surfaces, after the ceiling or wall panels have been completed, and which can be inserted and actuated through a small opening in the ceiling or wall. Such a support can be used for various fixtures, such as a junction box, light fixture, or ceiling fan. The support can be securely installed into the ceiling joists or wall studs (hereinafter referred to generally as "studs") through an opening cut into the wall or ceiling only large enough to receive the fixture to be mounted. The support can be easily installed and it is designed to be firm and able to withstand heavy loads. To this end it is intended now to provide an extensible rod-like support comprised of two telescoping members, one member having internal threads engaged by external threads on the other member, and each having threaded lag screws on their free ends so that when the members are oppositely rotated the members extend and the lag screws on their free ends penetrate the studs.

A particular object is to provide a support as described above which can be inserted through a relatively small opening in a wall or ceiling panel and through which opening the installer may apply wrenches, one for driving the internally threaded member and the other for driving the externally threaded member so that great amounts of torque can be oppositely applied to the members and so that the lag screws on the free ends of the members can be forced into the studs as they are screwed in.

The telescoping members each have nut surface means, the nut surface means on the externally threaded member being near the free outer end.

Because the nut on the externally threaded member is near the free outer end thereof (in order to provide maximum length for the external threads thereon) and because the distances between studs may vary greatly, it is further intended to provide tubular nut-driving wrenches of different lengths, a shorter one being for reaching the nut when the distance between the studs is not great, and the longer one for reaching the nut when the distance between the studs is relatively great and the nut is farther from the hole in the panel. These and other objects will be apparent from the following specifications and drawings, in which:

Figure 1:
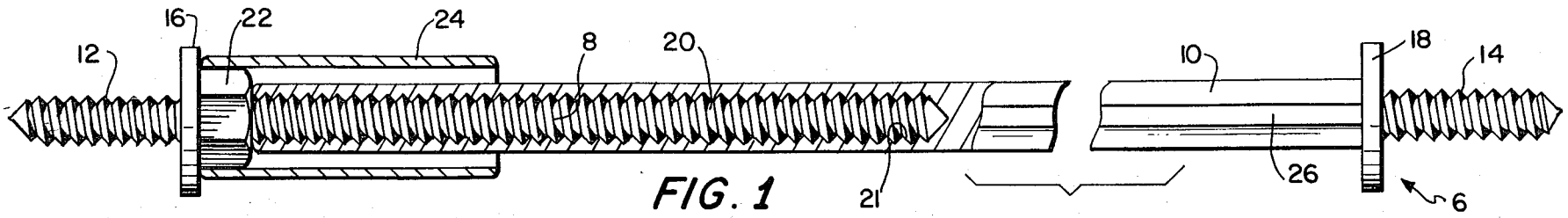
FIG. 1 is a side elevation of the support with a cut away section, showing a relatively short tubular nut-driving wrench applied to the nut on the externally threaded member.
Figure 3:
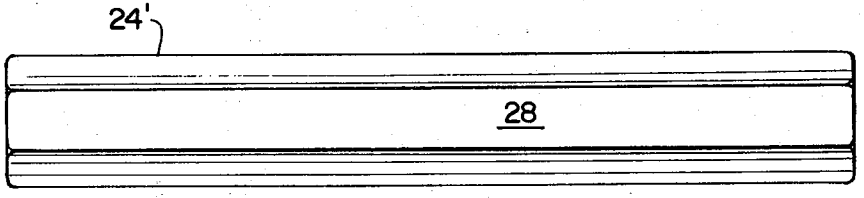
FIG. 3 is a plan view of a relatively long nut extender wrench.
Figure 2:
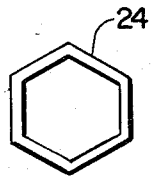
FIG. 2 is an end view of a tubular nut-driving wrench.

Referring now to the drawing in which like numerals denote similar elements, the support 6 is comprised of inner and outer telescoping members 8 and 10, each with lag screw ends 12 and 14, and stop members 16 and 18, at the inner ends of the lag screws. The inner telescoping member 8 has a long extensible threaded section 20 and affixed to the threaded section 20, adjacent to the stop member 16 is a large nut 22. The nut 22 is affixed to the inner telescoping member 8 so that rotation of the nut about its axis will result in like rotation of the inner telescoping member. The outer telescoping member 10 has a rod section with a hexagonal outer surface 26 which is threaded internally as at 21, so as to threadedly engage the externally threaded section 20 of the inner telescoping member 8. The outer diameter of the rod section 26 is smaller than the outer diameter of the nut 22.

A tubular nut-driving wrench 24, which has a hollow inner hexagonal surface, can be engaged over the nut 22 and is of a fit such that rotation of the tubular nut-driving wrench 24 about its axis drives the nut 22 on the inner telescoping member 8, thereby causing the telescoping members to screw towards or away from one another. The tubular nut-driving wrench 24 is also hexagonally shaped on its outside surface, which allows it to be firmly gripped by an open-ended wrench. However, because its inner diameter is larger than the outer diameter of member 10, it is free to rotate thereabout.

In operation, the tubular nut-driving wrench 24 is loosely placed over the rod section of the outer telescoping member 10, then the inner telescoping member 8 is threaded into the outer telescoping member. The tubular nut-driving wrench 24 is then slid toward the stop member 16 of the inner telescoping member 8 and engaged onto the large nut 22. Once assembled, the support is passed end wise through an opening in a wall or ceiling and held in position perpendicular to the opposing surfaces of two spaced studs 32, 32'. Two wrenches, one engaging the hexagonal surface of the outer telescoping member 10 and the other engaging the tubular nut-driving wrench 24, are used to turn each of the telescoping members in opposite directions until firm contact is made by the lag screws 12, 14 into the respective studs. At this point one of the wrenches is held stationary while the other is used to rotate the respective telescoping member until its lag screw is firmly seated in the stud. The latter wrench is then held stationary, while the first wrench is used to rotate the respective telescoping member to firmly seat the other lag screw in the opposing stud.

Figure 4:
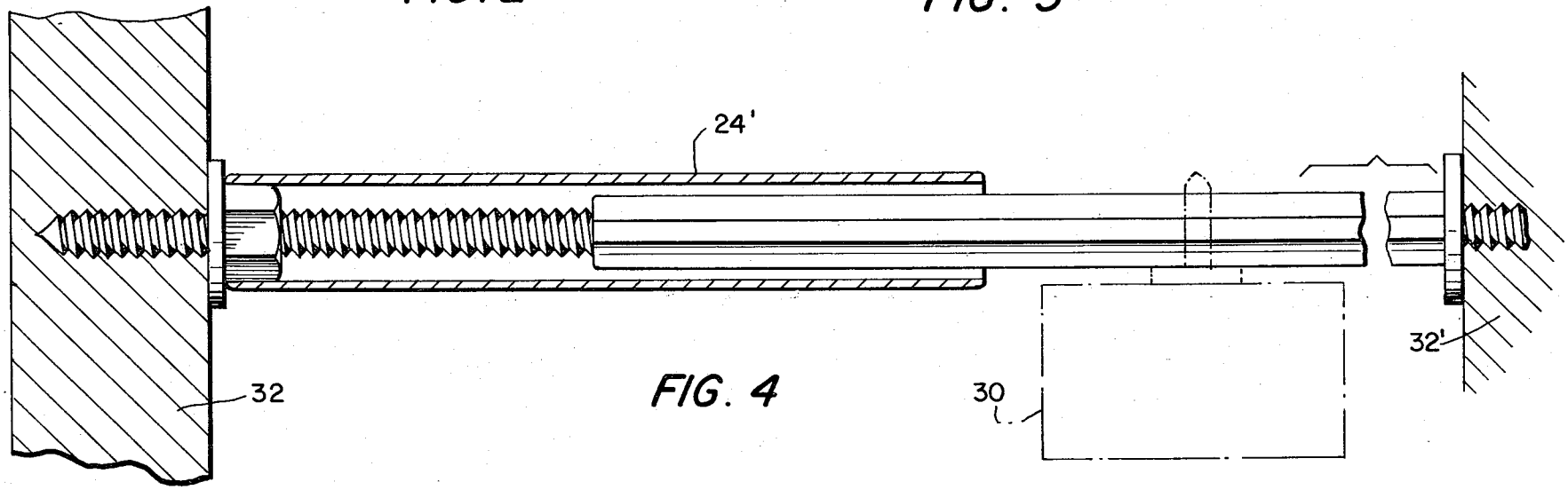
FIG. 4 is a side elevation of the support in place secured between studs, and showing the relatively long tubular nut-driving wrench engaged on the nut.

If an electrical fixture 30, shown in broken lines in FIG. 4, is to be installed it is then engaged onto the support by standard hanger means and fitted into the opening.

Different lengths of the tubular nut-driving wrench 24 or 24' can be provided, depending upon the distance between the studs. It will be understood that the directions of the pitches of the external and internal threads and of the threads on the lag screws are such that when one telescoping member is turned relative to the other in a direction which causes the members to extend, the same turning causes the associated lag screw to screw in.

The use of the tubular nut-driving wrench, enables the installer to use wrenches to securely install the support and firmly engage the lag screws of the support into the studs, and to drive them in, one at a time. While it is preferred to use the lag screws for engaging the elements which the support spans, other means may be substituted for the lag screws.

I claim:

1. An extensible support for spaning between spaced joists, studs and the like elements having opposed surfaces, which comprises:

outer and inner telescopically extensible rod-like members having internal and external threads, respectively, threadedly engaging one another and each having a free outer end portion with threaded lag screw means affixed thereon for screwing into one of said elements, the pitch angles of the threads on said members and said lag screw means being such that rotation of either of said members relative to the other in a direction such as to extend said support rotates the lag screw means thereon in that direction which screws the lag screw means thereon into an element.

2. An extensible support as claimed in claim 1, and nut flats on said members.

3. An extensible support as claimed in claim 2, the nut flats on the externally threaded member being on the outer end portion thereof.

4. An extensible support as claimed in claim 3, and a tubular nut-driving wrench engageable over said support, said wrench being freely rotatable and slidable over said outer member and having at one end an internal wrench surface drivingly engageable with the nut flats on the externally threaded member.

5. An extensible support for spanning between spaced joists, studs and the like elements having opposed surfaces, which comprises:

outer and inner telescopically extensible rod-like members having internal and external threads respectively threadedly engaging one another and having free outer end portions with element-engaging means thereon for engaging the elements between which the support spans, whereby rotation of either of said members relative to the other in a direction such as to extend said support drives the element-engaging means thereon towards the elements, respectively, and nut flats on said members, the nut flats on the externally threaded member being on the outer end portion thereof, and a tubular nut-driving wrench engageable over said support, said wrench being freely rotatable and slidable over said outer member and having at one end an internal wrench surface drivingly engageable with the nut flats on the externally threaded member.

* * * * *